US005201661A

United States Patent [19]

Ii

[11] Patent Number: 5,201,661

[45] Date of Patent: Apr. 13, 1993

[54] PRINTED CIRCUIT BOARD FLAT FLEXIBLE CABLE CONNECTOR

[75] Inventor: Hidehiro Ii, Yokohama, Japan

[73] Assignee: Molex Incorporated, Lisle, Ill.

[21] Appl. No.: 882,333

[22] Filed: May 13, 1992

[30] Foreign Application Priority Data

Jun. 18, 1991 [JP] Japan ..... 3-173243

[51] Int. Cl.[5] ..... H01R 9/09

[52] U.S. Cl. ..... 439/79; 439/260; 439/637

[58] Field of Search ..... 439/60, 67, 77, 79, 439/493, 495, 499, 630, 636, 637

[56] References Cited

U.S. PATENT DOCUMENTS

| | | | |
|---|---|---|---|
| 4,298,237 | 11/1981 | Griffith et al. | 439/637 |
| 4,367,006 | 1/1983 | Rehbogen, Jr. et al. | 339/176 MF |
| 4,385,795 | 5/1983 | Endoh et al. | 339/176 MF |
| 4,514,030 | 4/1985 | Triner et al. | 439/637 |
| 4,636,021 | 1/1987 | Bobb et al. | 439/260 |
| 4,842,538 | 6/1989 | Noschese | 439/260 |
| 4,869,672 | 9/1989 | Andrews, Jr. | 439/630 |
| 4,959,030 | 9/1990 | Tatebe et al. | 439/67 |
| 5,071,371 | 12/1991 | Harwath et al. | 439/637 |

*Primary Examiner*—Paula A. Bradley
*Attorney, Agent, or Firm*—Stephen Z. Weiss

[57] ABSTRACT

Disclosed is an improved edge connector for making contact with conductor on a flat flexible cable and a printed circuit board requiring only a possible smallest mounting space. An edge connector according to the present invention has terminals inserted in both front and rear portions of the housing. All of the terminals have flexible arms opposite support shelves for contacting a conductor on a cable. The solder tails of the terminals are arranged on bottom of the housing in four lines in a staggered fashion.

6 Claims, 7 Drawing Sheets

PRINTED CIRCUIT BOARD FLAT FLEXIBLE CABLE CONNECTOR

FIELD OF THE INVENTION

The present invention relates to a printed circuit board flat flexible cable connector to contain and keep a flat flexible cable parallel to a printed circuit board, and more particularly an improvement relating to such a cable connector having a housing equipped with a plurality of terminals whose solder tails are staggered and arranged on the bottom of the housing.

DESCRIPTION OF PRIOR ART

A variety of cable connectors have been widely used. There have been ever increasing demands for the reduction of the size of the printed board, and for the increase of the density with which circuit elements can be applied to the printed board. As for connectors associated with such printed boards, it is necessary to increase the number of terminals in the housing of a cable connector, while at the same time to reduce the space on the printed board that the solder tails of the connector terminals occupy.

Typically, a flat, flexible cable has only one side with conductors exposed. If two cables are to be connected to a printed circuit board, normally two connectors will be necessary. For each connector, a solder tail footprint will be required. To eliminate these dual solder tail footprints, a connector has been provided which allows for the insertion of two cables with their insulated portions next to one another and their exposed portions directed outside. If this connector is designed to have this sandwiched dual cable inserted perpendicular to the printed circuit board then the solder tails may be staggered sufficiently so as to provide a small foot print. If, however, the sandwiched cable or a single cable with exposed conductors on both sides is to be inserted parallel to a printed circuit board with the prior art connectors, where all of the terminals are inserted into the housing from the same side, the foot print must be extended laterally so that the terminals do not contact one another at the bottom of the housing.

SUMMARY OF THE INVENTION

The main object of the present invention is to solve the problems of the prior art to provide a connector to maintain either a flat, flexible cable with exposed conductors on both sides of the cable or two flat, flexible cables having only one side with exposed conductors parallel to a printed circuit board while maintaining a small solder tail foot print.

In order solve the problems of the prior art, this invention is provided which is a connector to contain and keep a flat, flexible cable, having exposed conductors on both sides, horizontal to a printed circuit board. The connector housing has front, rear, top and bottom walls. A cable insertion slot is formed in the housing front wall. Terminal insertion slots are in the front and rear walls of the housings.

Lower terminals inserted in the front of the housing have a base with a length alternating between adjacent lower terminals and are held in the housing parallel to and just above the housing bottom wall. The lower terminals have a flexible contact arm extending into the cable insertion slot from a "C" shaped bend located at one end of the lower terminal base which is first inserted into the housing front. The contact points on the arms make electrical contact with the exposed conductors of the bottom portion of said flat, flexible cable. Tails extend from an "L" shaped bend at the end of the base opposite the "C" shaped bend, so that the tails can pass through the bottom housing wall perpendicular to the printed circuit board. As a result of the alternating length of the lower terminal bases, the tails alternate passing through the housing bottom wall at different distances from the housing front wall whereby the tails form two rows parallel to the housing front and alternating in a staggered relationship.

A plurality of upper terminals are inserted into the rear terminal insertion slots. The upper terminals have a base with equal lengths and are held in the housing parallel to and just below the housing top wall. Flexible contact arms extend into the cable insertion slot from a "C" shaped bend at one end of the upper terminal base which is first inserted into the housing rear. Contact points on the arms make electrical contact with the exposed conductors of the upper portion of the flat, flexible cable. Tails extend from an "L" shaped bend at the end of the base opposite the "C" shaped bend so that the tails travel down along the rear housing wall. The tails are bent a second time so that the tails travel parallel to and above the housing bottom wall and below the lower terminals. They are bent a third time forming lengths between the second and third bends alternating between adjacent terminals so that the tails are not only perpendicular to the printed circuit board but also due to the alternating length of the tail formed by the third bend, the tails alternate passing through the housing bottom wall at different distances from the housing rear wall whereby the tails form two rows parallel to the housing rear wall and alternating in a staggered relationship.

The housing also has shelves opposite the contact points partially defining the cable insertion slot to support the cable while the contact points are forced into contact with the exposed cable conductors. The housing bottom wall may also be separate from the housing and have holes passing therethrough in a pattern cooperating with the pattern made by the staggered tails of the terminals. After all of the terminals are inserted completely into the housing the separate bottom wall is placed over the tails and into engagement with the housing thereby holding the tails and the terminals in place in the housing. This connector can also be used to connect two flat cables sandwiched together with the exposed conductors facing away from each other.

Other objects and advantages of the present invention will be understood from the following description of a flat flexible cable connector used to contain and keep a flat flexible cable horizontal to a printed circuit board according to a description of the preferred embodiment of the present invention, which is shown in accompanying drawings.

DETAILED DESCRIPTION OF THE PREFERRED EMBODIMENT

Figure 1:
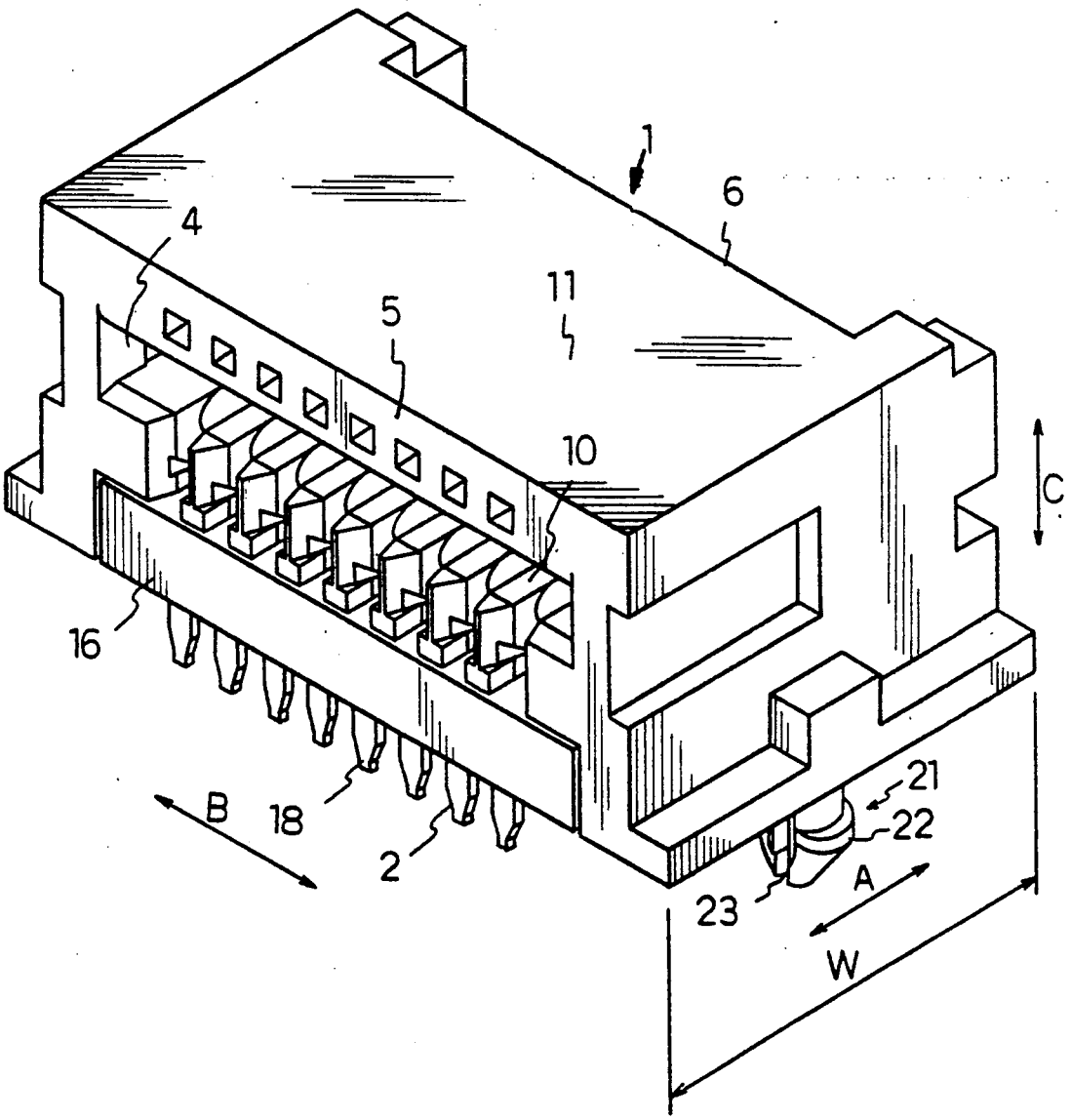
FIG. 1 is a perspective view of the flat flexible cable connector.

Referring to these drawings, a connector is discussed which contains and keeps a flat flexible cable horizontal to a printed circuit board. This connector comprises housing 1 and a plurality of terminals 30 and 31 fixed in housing 1. Housing 1 has a cable insertion slot 4 formed in its front 5 and extending in the front-to-rear direction A to permit insertion of a flexible cable 3 in housing 1, as seen from FIG. 6. The rear side of housing 1 which is the furthest from front 5 of housing 1 is indicated by 6. Insertion slot 4 extends lengthwise in direction B, which is perpendicular to the front-to-rear direction A, as seen from FIGS. 1 and 2.

Figure 3:
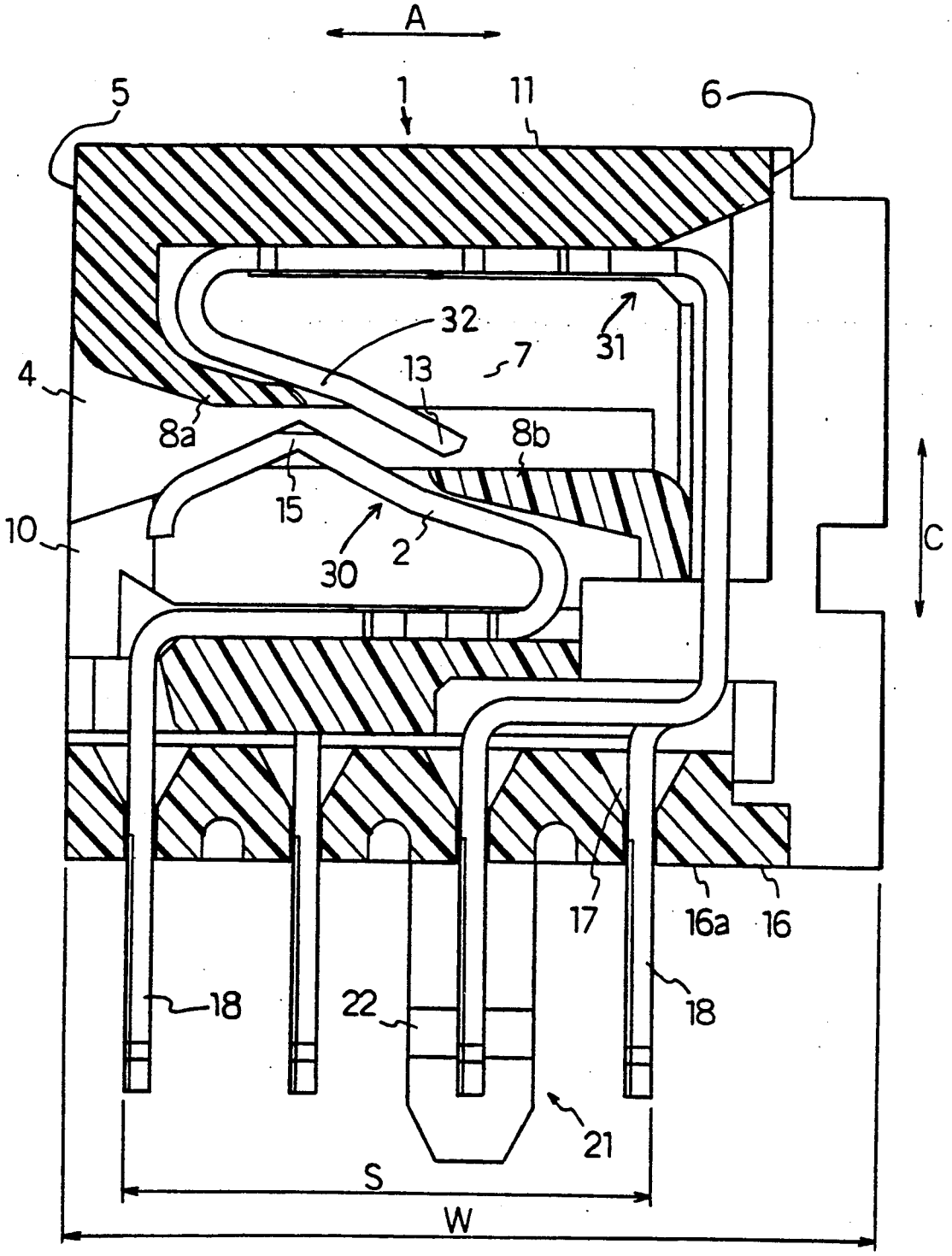
FIG. 3 is a sectional view of the connector taken along the line 3—3 in FIG. 2.
Figure 4:
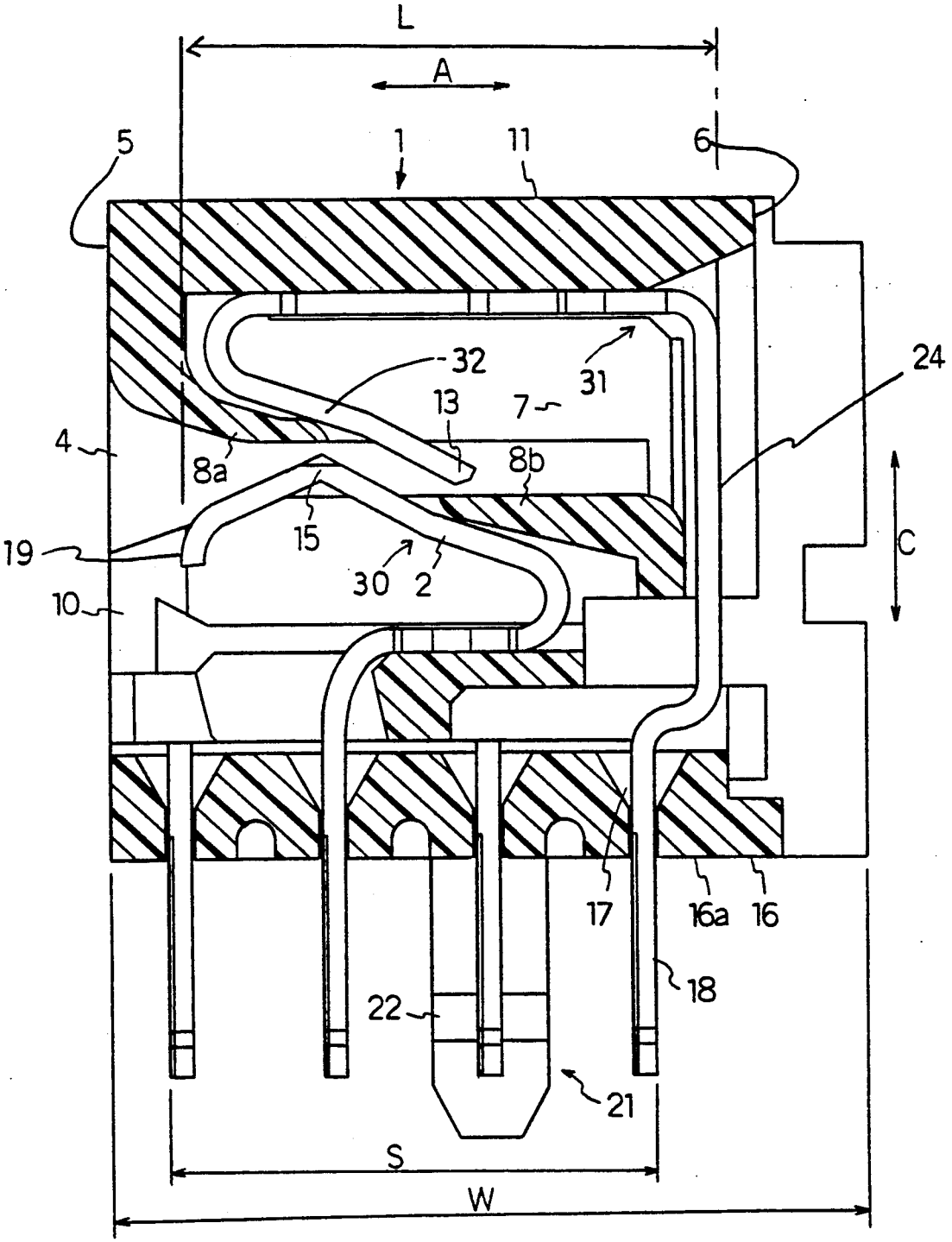
FIG. 4 is a sectional view of the connector taken along the line 4—4 in FIG. 2.
Figure 6:
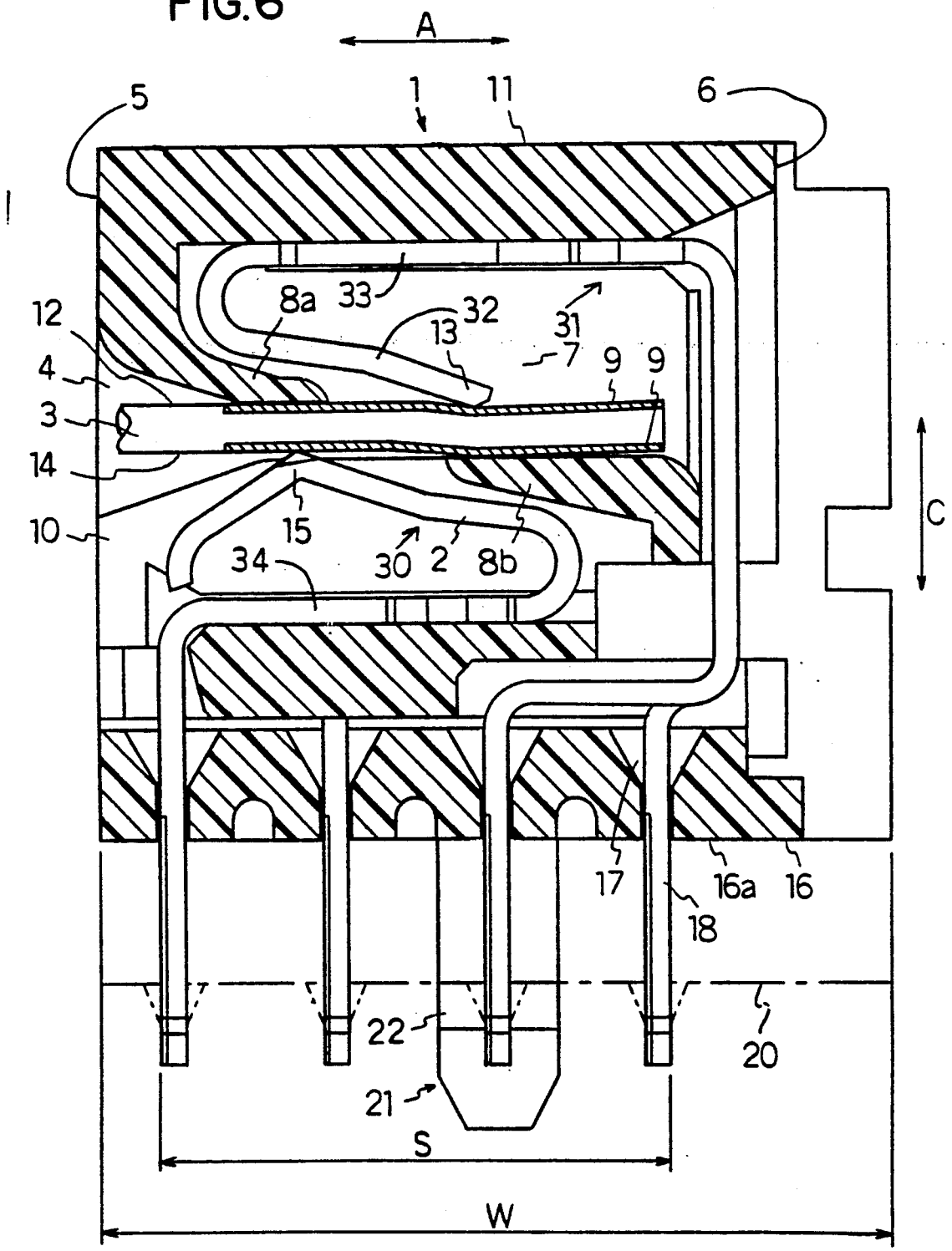
FIG. 6 is a sectional view of the connector showing the manner in which the edge of a flat flexible cable is contained and kept horizontally to the printed circuit board.
Figure 7:
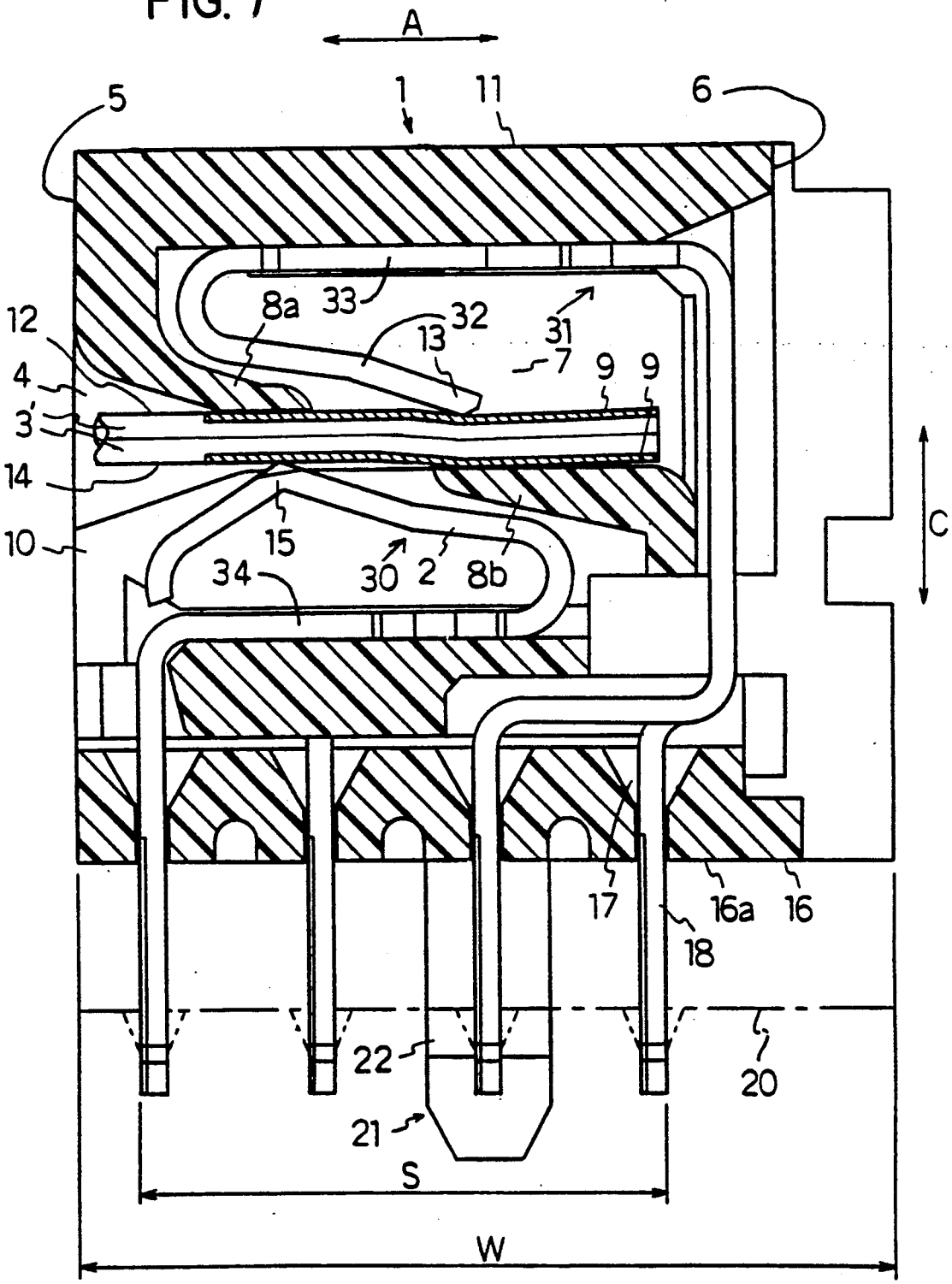
FIG. 7 is a sectional view of the connector showing the manner in which the edges of two flat, flexible cables sandwiched together are contained and kept horizontally to the printed circuit board.

As seen from FIGS. 3, 4 and 6, housing 1 has terminal mounting spaces or insertion slots 7 to communicate with the cable insertion slot 4, and has partition walls 10 provided at regular intervals longitudinally as indicated by B extending from the front to back direction A. These partition walls permit lateral arrangement of upper and lower terminals 30 and 31 at regular intervals and prevent direct contact between adjacent terminals. Upper and lower support shelves 8*a* and 8*b* are integrally connected to the upper front part and lower rear part of housing 1 respectively, extending horizontally in opposite directions in the spaces 7 toward the central longitudinal line of housing 1 to permit horizontal insertion of a flexible cable 3 with conductors 9 printed on its opposite major surfaces, as seen from FIG. 6. Specifically the upper major surface of the printed board 3 is put in contact with upper support shelve 8*a* to be guided thereby whereas the lower major surface of the cable 3 is put in contact with lower support shelve 8*b* to be guided thereby. An alternate embodiment shown in FIG. 7 would include two cables 3', 3' back to back with exposed conductors facing opposite one another.

Upper terminal 31 is fixed in the housing 1 so that it may be put in contact with a selected conductor 9 on the upper major surface 12 of the cable 3 when the upper terminal is inserted in the rear 6 of the housing 1 whereas lower terminal 30 is fixed so that it may be put in contact with a selected conductor 9 on the lower major surface 14 of cable 3 when the lower terminal is inserted in the front 5 of the housing 1. Specifically each upper terminal 31 consists of a base 33 with contact beam or arm 32 and solder tail 18 both integrally connected. Contact beam 32 extends from the base 33 from a C shaped bend into the cable insertion slot 4 and ends with contact point 13. Each contact point 13 is adapted to be put in contact with a selected conductor 9 on upper major surface 12 of printed board 3. Each contact point 13 is opposite a portion of the lower support shelf 8*b* which provides a resilient force to push the lower side of the cable so that a selected conductor in the upper major surface 14 makes contact with the selected contact point 13.

Likewise, each lower terminal 30 consists of a base 34 with a contact beam or arm 2 and solder tail 18 both integrally connected. Contact beam 2 extends from base 34 from a "C" shaped bend into the cable insertion slot 4 and again turns at contact point 15 and extends downward. Each contact point 15 is adapted to be put in contact with a selected conductor 9 on the lower major surface 14 of the printed board 3. Each contact point 15 is opposite a portion of the upper support shelve 8*a* which provides a resilient force to push the upper side of the cable so that a selected conductor in the cable lower major surface 14 makes contact with the selected contact point 15.

Figure 5:
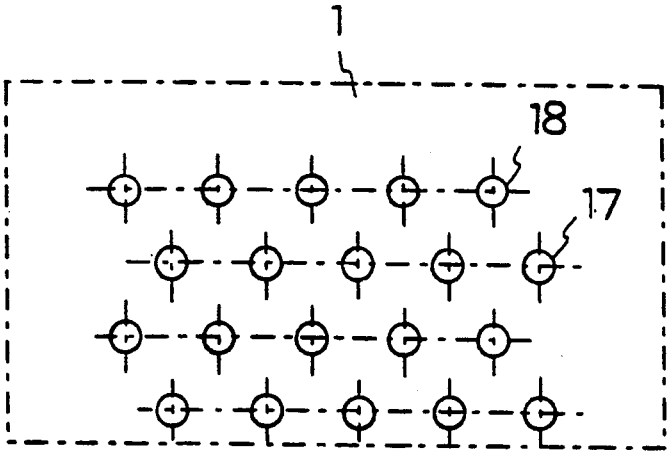
FIG. 5 shows schematically the staggered arrangement of the solder tails of the terminals and the holes in the bottom wall of the housing all in relation to the bottom perimeter wall of the housing.

Housing 1 has a plurality of holes 17 on its floor 16, thereby permitting the solder tail 18 of each terminal 30 and 31 to pass through floor 16 of housing 1 and partly appear from the bottom of housing 1. These holes 17 are staggered and arranged on the bottom of housing 1 so as to form four parallel lines, and accordingly projecting solder tails 18 are staggered and arranged on the bottom of housing 1 in four parallel lines, as seen from FIG. 5.

Figure 2:
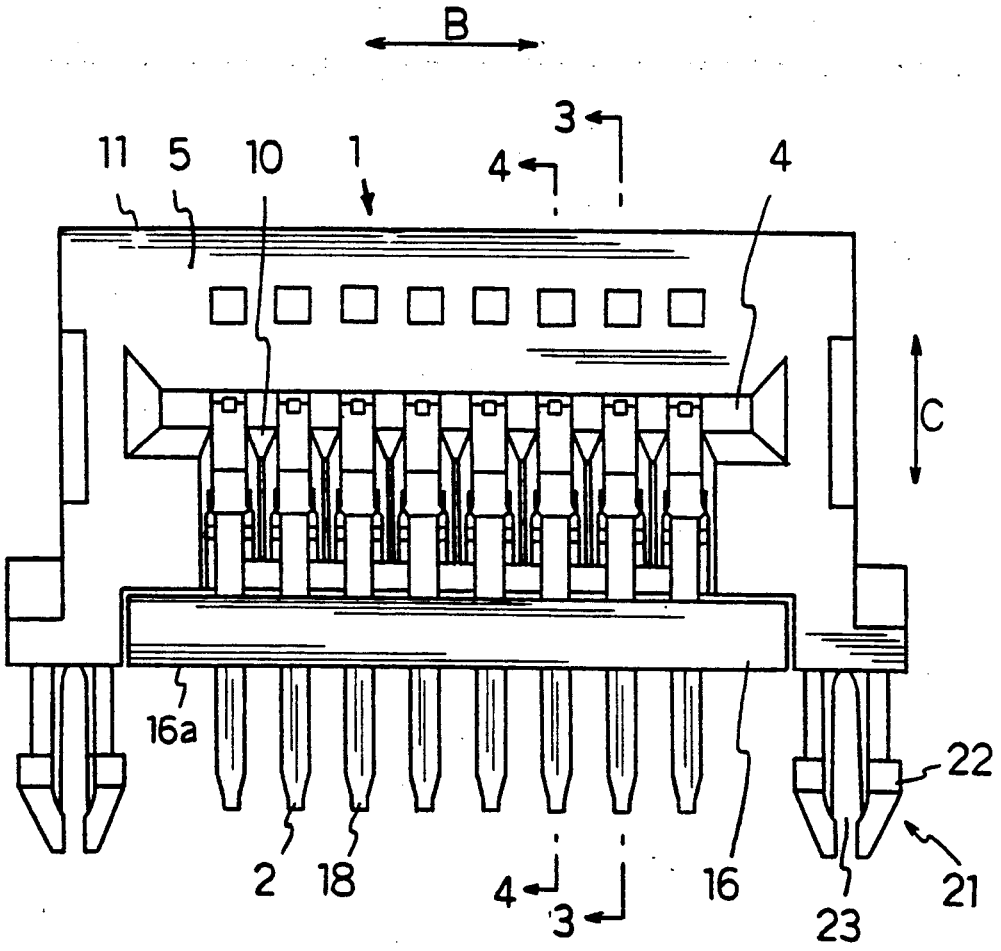
FIG. 2 is a front view of the connector.

Specifically referring to FIGS. 2 and 3, a pair of opposing terminals 30 and 31 which are crossed by the line 3—3 in FIG. 2 appear in complete form in FIG. 3. The solder tail 18 of the lower terminal 30 being on the first line and the solder tail 18 of upper terminal 31 being on the third line. Another pair of terminals 30, 31 which are crossed by the line 4—4 in FIG. 2 appear partly in FIG. 3. Specifically only their solder tails 18 appear. The solder tail 18 of the lower terminal 30 is on the second line and the solder tail 18 of the upper terminal 31 is on the fourth line. Here, it should be noted that all solder tails 18 project downwards from the bottom of housing 1, not extending laterally out of the area bounded by the four sides of the square housing bottom.

As may be understood from the above, upper and lower terminals 30 and 31 are fixed in the housing 1 so that the contact portions 13, 15 of the contact beams may be positioned above the bottom floor of housing within the lateral range of the farthest distance S from the first line of solder tails closest to insertion slot 4 to the fourth line of solder tails closest to the rear side of housing 1. In this particular embodiment contact portion 15 of lower terminal 30 whose solder tail 18 is in the first line is just above the second line of the staggered pattern, whereas the contact portion 13 of upper terminal counter-contact 31 whose solder tail 18 is in the third line is just between the second and third lines of the staggered pattern, as seen from FIG. 3.

Contact point 15 of lower terminal 30 whose solder tail 18 is in the second line is just above the second line of solder tails, whereas contact point 13 of upper terminal 31 whose solder tail 18 is in the fourth line is just between the second and third line of the staggered pattern, as seen from FIG. 4. Thus, all contact portions are arranged within the lateral range of farthest distance S from the first to fourth line of the staggered pattern. This arrangement requires no extension of the contact beams 2, 32 which are integrally connected both to contact ends 15 or 13 and bases 34 or 33 respectively, thus not necessitating increase of the lateral size W of housing 1. Specifically in FIG. 4, the distance L from the tip 19 of the lower terminal 30 which is closest to insertion slot 4 to the rear extension 24 of the upper terminal 31 which is closest to rear wall 6 need not be increased, and hence the lateral size W of housing 1 need not be increased, either. The staggering of the upper terminal 31 solder tails 18 is a result of the alternating length of the adjacent solder tail portions just above and parallel to the housing bottom. These solder tail portions are also below the bases 34 of the lower terminals.

Housing 1 has two split projections 21 on opposite bottom ends, thus permitting the mounting of housing 1 on a, printed board 20. As seen from FIGS. 1 and 2, each split projection 21 has a longitudinal slot 23 and an annular projection 22 to be resiliently fitted in and caught by a corresponding hole, which is made in a printed board.

In use, a flexible cable 3 is inserted in insertion slot 4. As the flexible cable 3 advances forward, lower terminal beam 2 is yieldingly bent downwards, thereby resiliently pushing itself against selected conductor 9 on the lower surface 14 of cable 3, and then upper terminal beam 32 is yieldingly bent upwards, thereby resiliently pushing itself against selected conductor 9 on the upper surface 12 of cable 3. At the same time, flexible cable 3 is supported by upper and lower support shelves **8*a* and 8*b*, thus putting cable 3 in correct vertical position in the direction indicated by C. Thus, reliable electric contacts are made between upper and lower terminals and conductors 9 on opposite major surfaces 12 and 14 of printed board 3**.

Next, split projections 21 of housing 1 are pushed in the corresponding holes of a printed board 20. Each split projection 21 reduces its diameter when passing through an associated hole, and as seen from FIG. 6, it returns to its original size when annular projection 22 appears from printed board 20, allowing annular projection 22 to expand, thus being caught by the circumference of the hole in locking condition. Thus, the cable connector is fixed to printed board 20. Selected conductors on printed board 20 can be soldered to solder tails 18 of board edge connector, thereby making necessary electric connections between selected conductors of flexible printed board 3 and those of printed board 20 via the connector terminals.

It will be understood that the invention may be embodied in other specific forms without departing from the spirit or central characteristics thereof. The present examples and embodiments, therefore, are to be considered in all respects as illustrative and to restrictive, and the invention is not to be limited to the details given herein.

I claim:

1. A connector to make electrical contact between the exposed conductors of a flat, flexible cable and a printed circuit board and to maintain the cable parallel to said board comprising:

a housing having front, rear, top and bottom walls, a cable insertion slot formed in the housing front wall into which said cable is inserted, a plurality of terminal insertion slots in the housing front and rear walls, a plurality of lower terminals inserted into the front terminal insertion slots, said lower terminals having a base with a length alternating between adjacent lower terminals, said lower terminal base held in the housing parallel to and just above the housing bottom wall having flexible contact arms extending into said cable insertion slot from a "C" shaped bend at one end of the front terminal base which is first inserted into the housing front, said arms making electrical contact at contact points with the exposed conductors of the bottom portion of said flat, flexible cable, and tails extending from an "L" shaped bend at the end of the base opposite said "C" shaped bend, so that the tails pass through the bottom housing wall perpendicular to the printed circuit board where, due to the alternating length of the lower terminal base, the tails alternate passing through the housing bottom wall at different distances from the housing front wall whereby the tails form two rows parallel to the housing front and alternating in a staggered relationship, and a plurality of upper terminals inserted into the rear terminal insertion slots, said upper terminals all having a base with equal lengths, said upper terminal base held in the housing parallel to and just below the housing top wall having flexible contact arm extending into said cable insertion slot from a "C" shaped bend at one end of the upper terminal base which is first inserted into the housing rear, said arms making electrical contact at contact points with the exposed conductors of the upper portion of said flat, flexible cable, and tails extending from an "L" shaped bend at the end of the base opposite said "C" shaped bend so that the tails travel down along the rear housing wall, said tails being bent a second time so that the tails travel parallel to and above the housing bottom wall and bent a third time forming lengths between the second and third bends alternating between adjacent terminals so that the tails are perpendicular to the printed circuit board where, due to the alternating length of the tail formed by the third bend, the tails alternate passing through the housing bottom wall at different distances from the housing rear wall whereby the tails form two rows parallel to the housing rear wall and alternating in a staggered relationship.

2. A connector as in claim 1 wherein said housing has shelves opposite said contact points partially defining said cable insertion slot to support said cable while the contact points are forced into contact with the exposed cable conductors.

3. A connector as in claim 2 wherein said housing bottom wall is separate from the housing and has holes passing therethrough in a pattern cooperating with the pattern made by the staggered tails of the terminals whereby after all of the terminals are inserted completely into the housing the separate bottom wall is placed over the tails and into engagement with the housing holding the tails and the terminals in place in the housing.

4. A connector to make electrical contact between the exposed conductors of two flat, flexible cables sandwiched together with the exposed conductors facing away from one another and a printed circuit board and to maintain the cable parallel to said board comprising:

a housing having front, rear, top and bottom walls, a cable insertion slot formed in the housing front wall into which said cable is inserted, a plurality of terminal insertion slots in the housing front and rear walls, a plurality of lower terminals inserted into the front terminal insertion slots, said lower terminals having a base with a length alternating between adjacent lower terminals, said lower terminal base held in the housing parallel to and just above the housing bottom wall having flexible contact arms extending into said cable insertion slot from a "C" shaped bend at one end of the lower terminal base which is first inserted into the housing front, said arms making electrical contact at contact points with the exposed conductors of the lower flat, flexible cable, and tails extending from an "L" shaped bend at the end of the base opposite said "C" shaped bend, so that the tails pass through the bottom housing wall perpendicular to the printed circuit board where, due to the alternating length of the lower terminal base, the tails alternate passing through the housing bottom wall at different distances from the housing front wall whereby the tails form two rows parallel to the housing front and alternating in a staggered relationship, and a plurality of upper terminals inserted into the rear terminal insertion slots, said upper terminals having a base with equal lengths, said upper terminal base held in the housing parallel to and just below the housing top wall having a flexible contact arm extending into said cable insertion slot from a "C" shaped bend at one end of the rear terminal base which is first inserted into the housing rear, said arms making electrical contact at contact points with the exposed conductors of the upper flat, flexible cable, and tails extending from an "L" shaped bend at the end of the base opposite said "C" shaped bend so that the tails travel down along the rear housing wall, said tails being bent a second time so that the tails travel parallel to and above the housing bottom wall and bent a third time forming lengths between the second and third bends alternating between adjacent terminals so that the tails are perpendicular to the printed circuit board where, due to the alternating length of the tail formed by the third bend, the tails alternate passing through the housing bottom wall at different distances from the housing rear wall whereby the tails form two rows parallel to the housing rear wall and alternating in a staggered relationship.

5. A connector as in claim 4 wherein said housing has shelves opposite said contact points partially defining said cable insertion slot to support the cables while the contact points are forced into contact with the exposed cable conductors.

6. A connector as in claim 5 wherein said housing bottom wall is separate from the housing and has holes passing therethrough in a pattern cooperating with the pattern made by the staggered tails of the terminals whereby after all of the terminals are inserted completely into the housing the separate bottom wall is placed over the tails and into engagement with the housing holding the tails and the terminals in place in the housing.

* * * * *